US006478218B1

(12) United States Patent
Boatwright et al.

(10) Patent No.: US 6,478,218 B1
(45) Date of Patent: Nov. 12, 2002

(54) CONTAINER HAVING A PRESHAPED END CLOSURE

(75) Inventors: Floyd H. Boatwright; Richard M. Lowman, both of Hartsville; Alan D. Williams, Camden, all of SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/685,346

(22) Filed: Oct. 10, 2000

(51) Int. Cl.[7] ..... B65D 43/04
(52) U.S. Cl. ..... 229/125.05; 220/258; 229/5.5
(58) Field of Search ..... 229/5.5, 123.1, 229/123.2, 125.05; 220/254, 258, 359.3; 156/69

(56) References Cited

U.S. PATENT DOCUMENTS

| | | | | |
|---|---|---|---|---|
| 1,128,266 A | | 2/1915 | Arnott | |
| 1,344,240 A | | 6/1920 | McColl et al. | |
| 2,582,541 A | | 1/1952 | Harrison | |
| 4,078,696 A | | 3/1978 | Crisci | |
| 4,098,404 A | * | 7/1978 | Markert | 229/5.5 |
| 4,154,360 A | * | 5/1979 | Smith | 229/125.05 |
| 4,158,425 A | | 6/1979 | Sansbury | |
| 4,360,119 A | | 11/1982 | Olivo | |
| 4,522,332 A | * | 6/1985 | Munk | 229/125.05 |
| 4,557,414 A | * | 12/1985 | Ford et al. | 229/5.5 |
| 5,829,669 A | | 11/1998 | Drummond et al. | |
| 5,971,259 A | | 10/1999 | Bacon | |
| 5,988,493 A | | 11/1999 | Clougherty | |
| 6,131,804 A | * | 10/2000 | Julian | 220/258 |
| 6,196,450 B1 | * | 3/2001 | Varadarajan et al. | 229/123.2 |

FOREIGN PATENT DOCUMENTS

| | | |
|---|---|---|
| EP | 0 949 152 A1 | 10/1999 |
| NL | 1010946 | 2/2000 |

* cited by examiner

*Primary Examiner*—Gary E. Elkins
(74) *Attorney, Agent, or Firm*—Alston & Bird LLP

(57) ABSTRACT

A tubular container for vacuum packaging products is provided according to the present invention that includes an overcap secured to at least one of the opposed ends of a tubular container that defines a bias member for biasing a membrane-type flexible lid inwardly towards products contained within the tubular container before a vacuum is applied. The flexible lid is maintained in a biased shape until the bias member is removed. As such, the flexible lid is sufficiently restrained during the vacuum packaging process, thus preventing the breakage of products located adjacent the flexible lid.

7 Claims, 4 Drawing Sheets

CONTAINER HAVING A PRESHAPED END CLOSURE

FIELD OF THE INVENTION

The present invention relates to composite containers, and in particular relates to composite containers for vacuum packaging fragile products, such as potato crisps or cookie biscuits, and associated methods.

BACKGROUND OF THE INVENTION

Food and drink products and other perishable items are often packaged in tubular containers that are sealed at both ends. For some time, it has been recognized that substantial economies, as well as environmental advantages, can be realized by the use of composite containers, as opposed to the traditional glass and metal containers. These composite containers typically include at least one structural body ply made of paperboard and are formed by wrapping a continuous strip of the body ply material around a mandrel of a desired shape to create a tubular structure. At the downstream end of the mandrel, the formed tube is cut into discrete lengths and fitted with end closures to form the container.

Tubular containers of this type typically include a liner ply on the inner surface of the paperboard body ply. The liner ply prevents liquids from leaking out of the container and also prevents liquids from entering the container and possibly contaminating the food product contained therein. Preferably, the liner ply is also resistant to the passage of gasses so as to prevent odors of the food product in the container from escaping and to prevent atmospheric air from entering the container through the liner and spoiling the food product. The liner ply is often a laminate including kraft paper, aluminum foil and/or one or more polymer layers. Thus, the liner ply provides barrier properties and the body ply provides structural properties for the composite container. In addition, a label ply is typically adhered to the outer surface of the paperboard body ply.

Certain food products benefit from being packaged while under a vacuum. Vacuum packaging removes oxygen from the space surrounding the product, which can improve the shelf life of the product within the package. This is especially true for perishable food products, or food products that may become stale if exposed to air. However, it is generally recognized that vacuum packaging in some tubular containers can only be accomplished with difficulty, if at all. Because of the structural design of the composite container, the application of vacuum to the interior of the container often results in partial or complete inward collapsing of the container walls along the length of the container. This can result in an unacceptable appearance for the composite container or an unacceptable sealing of the product within the container.

This problem is further discussed in U.S. Pat. No. 4,158,425, assigned to the assignee of the present invention and incorporated herein by reference. To avoid the partial or complete collapsing of the paperboard body ply of the container upon application of a vacuum inside the container, the container according to the '425 patent has an impermeable or hermetically sealed liner secured interiorly to the container body solely at the opposed ends thereof with the major length of the liner being free of the tubular body so as to allow an inward contracting of the liner without the introduction of excessive stresses to the container body itself. A vacuum or reduced pressure atmosphere within the liner causes an inward deformation of the liner into contact with the product substantially independently of the surrounding container body. Thus, the stresses which are transferred to the container body are at the opposed ends thereof which are in turn structurally supported by a pair of conventional end closures.

The '425 patent, however, only addresses the problem of collapsing of the container walls. The '425 patent does not discuss or provide a container designed to secure the food products during transportation or to prevent breakage of the food products during packaging. In particular, fragile food products, such as potato crisps or cookie biscuits, are extremely susceptible to breakage during transportation and packaging. These types of products are typically stacked within the container such that the products can move about the container. Although the '425 patent provides an inwardly moving liner, it is directed to sealing the product for freshness without damaging the tubular body, and not directed to providing cushioning support to the food products in order to prevent damage during transportation and packaging.

The problem of securing food products during transportation is addressed in copending application 09/543,439 entitled "Container and Method for Making Container for Fragile Products," assigned to the assignee of the present invention and herein incorporated by reference. The container disclosed by the 09/543,439 application includes a flexible end closure secured to at least one of the opposed ends of the container that is free to move inwardly against food products contained therein when a vacuum is applied so as to provide cushioning support to the food products. As such, the food products are supported by a "pillow-like" cushion instead of a metal end closure or other rigid surface as provided by current containers. Despite the advantages provided by the flexible end closure disclosed by the 09/543,439 application, certain food products still suffer from breakage during the packaging process, particularly those products that are vacuum packed. In particular, it is believed that the vacuum packaging process causes the flexible end closure to move rapidly inward against the adjacent fragile products within the container, causing the products located near the end closure to be broken. Seeing broken cookies or potato crisps when the container is opened is very undesirable from a consumer standpoint and may lessen consumer appeal for the food products.

A conventional process for packaging food products includes sealing a flexible end closure, such as a membrane, to one end of the tubular container, inverting the container with the flexible end closure attached thereto, and depositing the products within the tubular container such that the products first deposited into the container rest against the inner surface of the flexible end closure. The remaining food products are then stacked upon one another until the container is sufficiently full. The filled container is placed inside a vacuum chamber and the chamber is depressurized to create a vacuum. The open end of the tubular container is then closed while the container and its contents are subjected to the vacuum. The vacuum chamber is then repressurized, which causes the flexible end closure of the sealed tubular container to move rapidly inward towards the food products. This rapid movement of the flexible end closure acts against the weight of the stacked food products that are resting against the inner surface of the flexible end closure. As such, the rapid movement of the flexible end closure results in a sharp pressing force against the food products, particularly against the food products adjacent the flexible end closure. The pressing force often results in breakage of the food products adjacent the flexible end closure, as these food products receive the brunt of the pressing force from the flexible end closure.

Accordingly, there is a need in the industry for a container that hermetically seals perishable food products, but that is also capable of protecting fragile food products during packaging, and particularly capable of preventing breakage of the food products located adjacent the end closures. At the same time, however, such a container would also be capable of withstanding the rigors of vacuum packaging so as to increase the shelf life of the product and provide other benefits attendant to vacuum packaging.

SUMMARY OF THE INVENTION

These and other needs are provided, according to the present invention, by a tubular container having an overcap secured to at least one of the opposed ends of the container that defines a bias member for biasing a membrane-type flexible end closure or lid inwardly towards the food products before a vacuum is applied. The bias member also displaces the food products so that the flexible lid can move inwardly without exerting significant force on the food products. As such, the rapid and excessive movement of the flexible lid during conventional vacuum packaging is avoided, thus preventing the breakage of the food products located adjacent the flexible lid.

In particular, the tubular composite container for vacuum packaging products, such as potato crisps, cookie biscuits, baked wafers or the like, includes a tubular body ply formed of a paperboard material having inner and outer surfaces and opposed ends. At least one end of the body ply is rolled outwardly to form a rim. The tubular body is formed using conventional spiral winding techniques known in the art, such as described in U.S. Pat. No. 4,185,425, which is assigned to the assignee of the present invention and incorporated herein by reference.

The tubular composite container also includes a flexible membrane-type end closure or lid that is positioned against the rim and sealed thereto. The flexible lid moves inwardly against the products contained within the tubular body when a vacuum is applied so as to provide cushioning support for the products. In one embodiment, the flexible lid includes a foil layer that is impervious to the passage of liquids and gasses.

Advantageously, the tubular composite container also includes an overcap attached to the container adjacent the flexible lid. The overcap defines a bias member for biasing the lid inwardly towards the food products before a vacuum is applied. In one embodiment, the bias member comprises at least one rib, which may have a thickness substantially equal to the base portion of the overcap. In another embodiment, the bias member has a tubular shape. In yet another embodiment, the bias member has a frustoconical shape. The bias member can be formed by profiling or shaping the surface of the overcap, which in one embodiment gives the overcap a concave outer surface and convex inner surface. The bias member can also be formed by providing a rib or other shape extending from the inner surface of the overcap so that the outer surface remains substantially planar.

Associated methods also form a part of the invention and, according to one embodiment, include the steps of attaching a flexible lid to at least one of the opposed ends of a tubular body member, biasing the flexible lid inwardly with a bias member, and depositing one or more products inside the tubular body member. The vacuum packaging operation can then be performed by creating a vacuum or negative pressure inside a chamber storing the open tubular body and then closing the open end of the tubular body. The negative pressure created inside the chamber is then released such that the flexible lid can move inwardly towards the food products. However, because the flexible lid is substantially biased inwardly by the bias member before the vacuum packaging operation is performed, the flexible lid undergoes substantially less inward movement when the vacuum is released inside the chamber, thereby reducing breakage to the food products located adjacent the flexible lid. In one preferred embodiment, the bias member is incorporated into the overcap, although the bias member can have other configurations.

Accordingly, and as is explained in more detail below, the Applicants have provided a new container for vacuum packaging products which overcomes the disadvantages of conventional containers. The container and method of the present invention is particularly advantageous for food products that are easily damaged during packaging, such as potato crisps or cookie biscuits, although other fragile products, such as electronics and the like, can also be stored in the container of the present invention. The new container is easy to open for consumers, and can use conventional construction techniques. At the same time, however, the present container is capable of withstanding the rigors of vacuum packaging so as to maintain a rigid shape and provide a hermetically sealed container to prevent air and moisture from contaminating the products contained therein.

BRIEF DESCRIPTION OF THE DRAWINGS

While some of the objects and advantages of the present invention have been stated, others will appear as the description proceeds when taken in conjunction with accompanying drawings, which are not necessarily drawn to scale, wherein.

DETAILED DESCRIPTION OF THE INVENTION

The present invention now will be described more fully hereinafter with reference to the accompanying drawings, in which preferred embodiments of the invention are shown.

This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
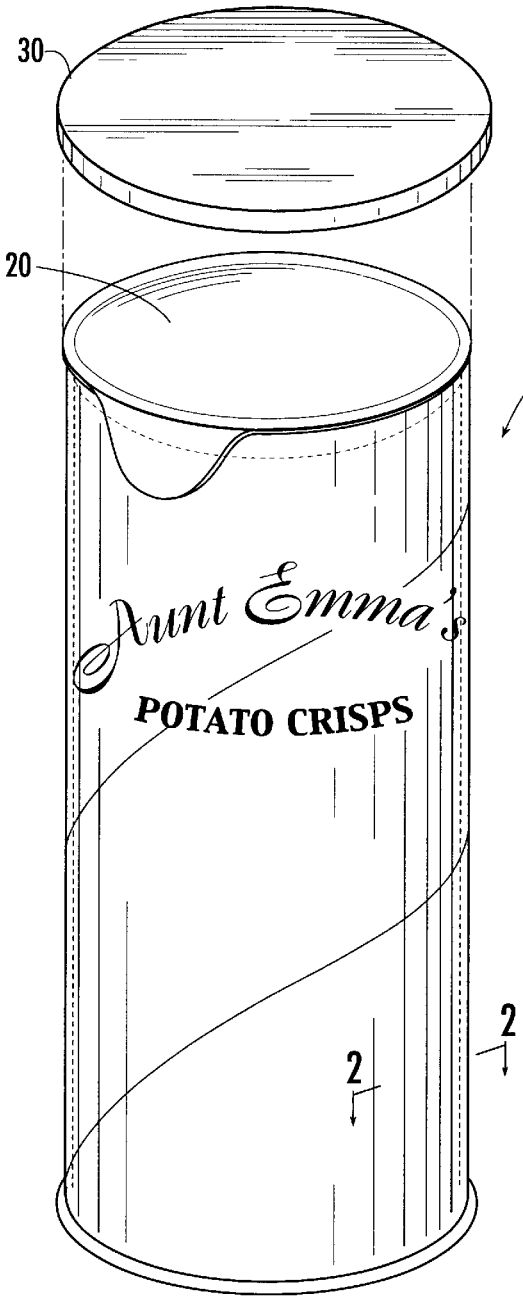
FIG. 1 is a perspective view of a container of the present invention.
Figure 2:
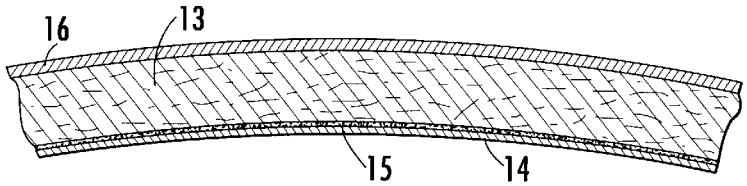
FIG. 2 is a greatly enlarged sectional view of the container of the present invention as seen along lines 2—2 of FIG. 1.

Turning first to FIGS. 1–2, tubular container 10 is illustrated and is particularly advantageous for packaging food products 11, such as potato crisps or cookie biscuits. Other products may also be stored in the container 10, such as electronics and other nonfood products. Although illustrated as having a circular cross section, the tube of the container 10 may have any cross sectional shape that can be formed by wrapping the tube around an appropriately shaped mandrel. One example is a generally rectangular shaped tube having rounded corners. As illustrated in more detail in FIG. 2, the tubular container 10 includes a body wall comprising at least one tubular body wall or ply 13 that is preferably formed of a strip of paperboard. The body ply 13 may be advantageously composed of conventional spiral wound paperboard having a thickness of about 0.15–0.30 inch. Such a body ply 13 is described in U.S. Pat. No. 5,988,493, which is herein incorporated by reference.

The tubular container 10 also includes a liner ply 14 comprising a polymeric material and adhered to the inner surface of the body ply 13. In particular, the liner ply 14 is constructed of multiple layers. In a preferred embodiment, the liner ply 14 includes an outer layer, such as a craft paper, having inner and outer surfaces. A foil layer provides barrier properties. Liner plies such as described in U.S. Pat. No. 5,829,669, which is herein incorporated by reference, may also be used.

As mentioned above, the liner ply 14 is secured to the body ply 13 by an adhesive layer 15. In one embodiment, the adhesive layer 15 comprises a polyvinyl material, although other materials may also be used. The adhesive layer 15 may be applied to the entire inner surface of the body ply 13 or may be applied in a pattern configuration.

In one embodiment, the tubular container 10 of the present invention also includes a flexible end closure or lid 20 (sometimes referred to as a "membrane") that is affixed to an end of the tubular container 10. The other end closure of the tubular container 10 may be constructed of steel or aluminum plate with applied coatings and/or electrolytic tinplate. The flexible lid 20 is preferably made of a flexible laminate made of films, kraft paper, foil, and/or extruded polymers and is heat sealed or adhesively attached to the end of the tubular container 10.

Figure 1A:
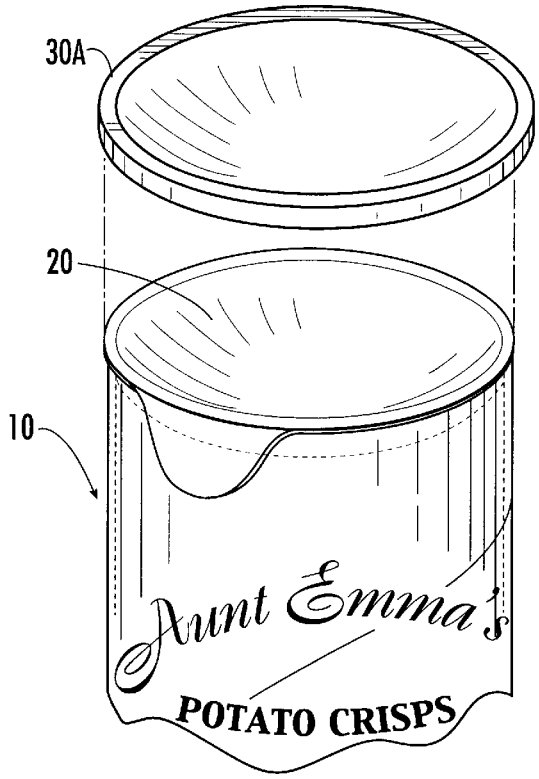
FIG. 1*a* is a perspective view of a portion of the container of FIG. 1 according to one embodiment of the present invention.

In particular, the flexible end closure 20 includes a barrier layer that serves as a barrier to the passage of liquids and/or gasses such as oxygen. If a barrier is required for both liquids and gasses, the barrier material is preferably selected from the group consisting of metal foil, such as aluminum foil, polyethylene terapthalate, modified polyethylene terapthalate, polyethylene napthalate, polyamide, metallized and silicate coated polyester, metallized and silicate polypropylene, metallized polyamide, polyvinylidiene chloride, ethylene vinyl alcohol and mixtures thereof. Other layers may be disposed on the outermost surface of the flexible lid 20 away from the inside of the tubular container 10, including paper or paperboard layers, such as a kraft paper layer. The tubular container 10 also includes an overcap 30 which is secured to an end of the container 10 over the flexible lid 20. The overcap can have several embodiments, as shown in FIGS. 1 and 1A and as discussed more fully below.

Figure 3:
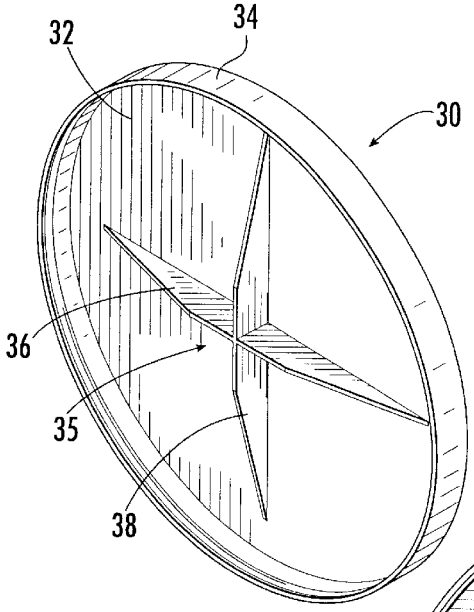
FIG. 3 is a sectional view of an overcap having a bias member according to one embodiment of the present invention.
Figure 4:
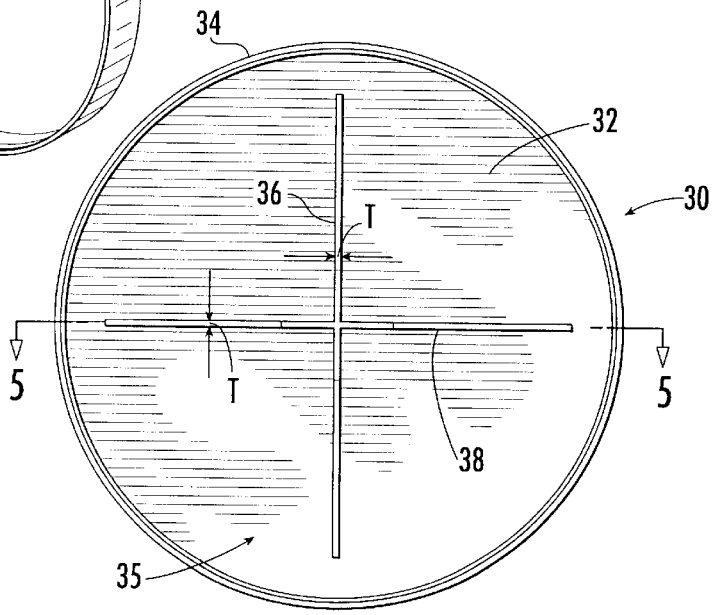
FIG. 4 is an end view of the overcap shown in FIG. 3.

FIGS. 3–6 illustrate one particular embodiment of the overcap 30 according to the present invention. In particular, the overcap 30 includes a base wall 32 and a side wall or skirt 34 that extends perpendicularly from the base wall 32. The overcap 30 is preferably made from a polymeric material, such as low density polyethylene, although other polymeric materials known in the art can also be used. In a presently preferred embodiment, the overcap 30 defines a bias member 35 that extends away from the base wall 32 and towards the inside of the tubular container 10. According to one embodiment, the bias member 35 includes a rib 36. The rib 36 has a thickness T that is substantially equivalent to the thickness of the base wall 32, although other dimensions may also be used depending on manufacturing guidelines known in the art. In one embodiment, the rib 36 extends radially across the base wall 32. Other shapes may also be used that would be obvious to one of skill in the art, such as a shape comprising a plurality of concentric disks arranged so that each disk has a smaller radius as the disks extend away from the base wall 32. As shown in FIG. 3, the bias member 35 also includes a rib 38 that extends away from the base wall 32 and perpendicular to the rib 36, thus forming a "X" or "T" shaped configuration. The bias member 35 can also be formed by profiling or shaping the base wall 32 into the desired shape. For example, FIG. 1A shows an overcap 30A having an indented form, wherein the outer surface of the overcap has a concave form. Other shapes, such as those mentioned herein, can also be formed by shaping the base wall 32 of the overcap 30A. Advantageously, profiling the overcap in this manner may yield manufacturing efficiencies compared to other embodiments, since a portion of the base wall itself is shaped into the bias member.

Figure 5:
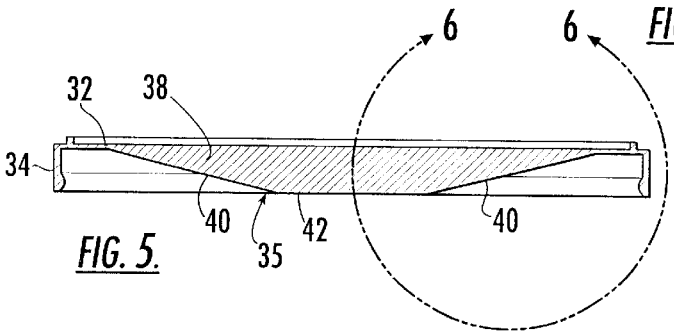
FIG. 5 is a sectional view of the overcap as seen along the lines 5—5 of FIG. 4.
Figure 6:
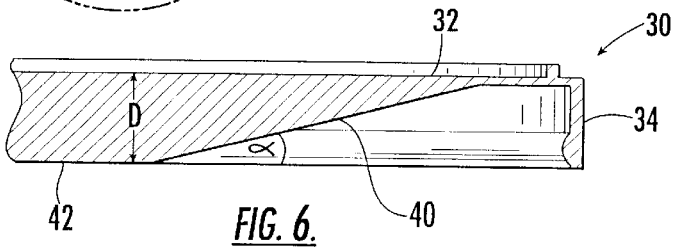
FIG. 6 is a greatly enlarged sectional view of the overcap as seen along lines 6—6 of FIG. 5.

FIGS. 5 and 6 show a more detailed sectional view of the bias member 35 and the rib 38. More specifically, the rib 38 defines a distal surface 42 and tapering surfaces 40 that join the distal surface 42 with the base wall 32. The tapering surfaces 40 and distal surface 42 define an angle $\alpha$ therebetween, which is about 20 degrees, and can be determined analytically or for manufacturing purposes. In addition, the distal surface 42 is spaced away from the base wall 32 a distance D, which is, in one embodiment, approximately equal to the length of the side wall 34 multiplied by 0.95. Other amounts are also possible for the distance D. At a minimum, however, the distance D must be great enough so that the distal surface 42 is located inside the end of the container 10 when the overcap 30 is applied thereto.

Figure 7:
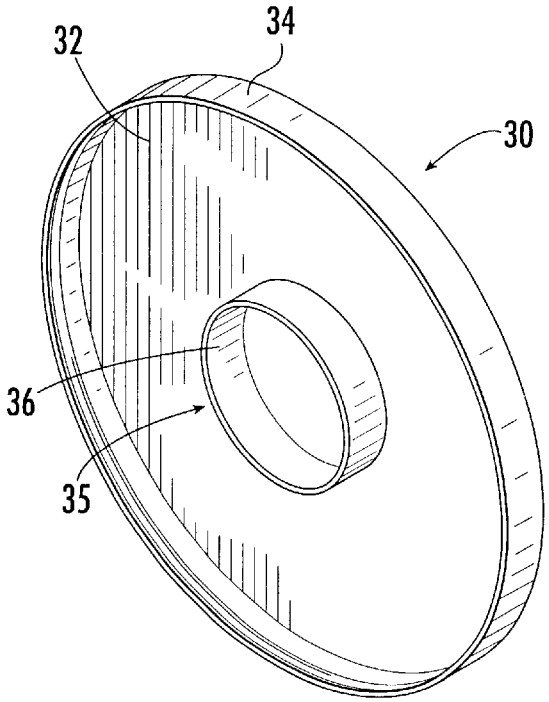
FIG. 7 is a perspective view of an overcap according to another embodiment of the present invention.
Figure 8:
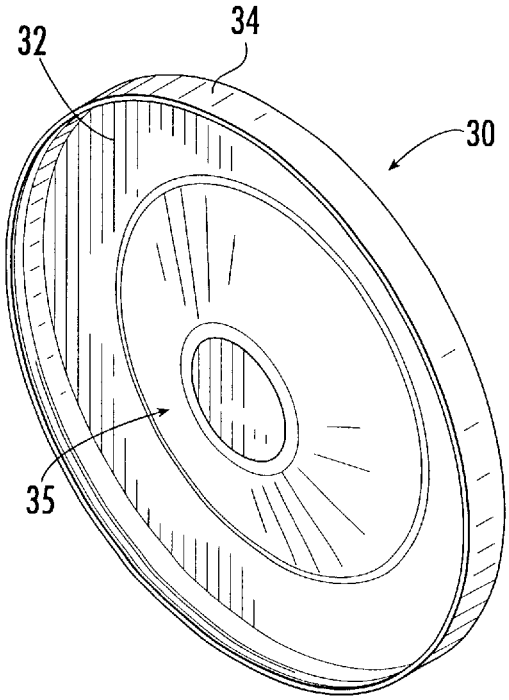
FIG. 8 is a perspective view of an overcap according to yet another embodiment of the present invention.

FIGS. 7 and 8 show alternative configurations of the bias member 35. In particular, FIG. 7 shows the bias member 35 having a tubular or curved configuration. Alternatively, FIG. 8 shows the bias member 35 having a frustoconical configuration. As stated above, these embodiments are shown for example purposes only, and not by way of limitation, such that other configurations of the bias member 35 will be apparent to those of skill in the art.

The container 10 of the present invention is particularly advantageous for the packaging of food products 11, and in particular the packaging of fragile food products in a reduced pressure environment. As discussed above, fragile food products, such as potato crisps and cookie biscuits, are particularly disposed to breakage during vacuum packaging, where the vacuum packaging process itself causes the flexible lid 20 to hit against the food products 11 located adjacent the flexible lid. With the present invention, the flexible end closure 20 is biased inwardly towards the food products by the bias member 35 of the overcap 30 before a vacuum is applied. As such, the flexible lid is prevented from rapid and forceful movement during the vacuum packaging process, which thereby protects the food products 11 located adjacent the flexible lid 20 from being broken or damaged during packaging.

As described in a preferred embodiment, the overcap 30 includes the bias member 35. However, the present invention is not intended to be limited to this embodiment. In this regard, the bias member can have other shapes and configurations. For example, in one alternative embodiment the bias member is separate from the overcap and comprises a disk of compressible material, such as cardboard or plastic. In another alternative embodiment, the bias member comprises a dome-shaped insert that is placed between the overcap and the flexible lid. In yet another embodiment, the bias member is attached to the overcap using double-sided tape or an adhesive.

A method of manufacturing a sealed composite container is also provided by the present invention. In particular, the method includes forming the tubular body ply 13 according to conventional spiral winding techniques known in the art, such as described in U.S. Pat. No. 4,185,425, which is herein incorporated by reference. At least one end of the tubular body ply 13 is rolled outwardly to form a rim which provides a suitable surface for affixing the flexible end closure 20. The method also includes placing the overcap 30 over the flexible lid 20 and biasing the flexible lid inwardly with the bias member 35 of the overcap 30 when the overcap is placed over the flexible lid. Advantageously, the flexible lid 20 is maintained in a biased shape until the overcap 30 is removed.

A method of packaging products is also provided by the present invention. The method includes attaching the flexible lid 20 to at least one of the opposed ends of the tubular body ply 13. The method also includes placing the overcap 30 over the flexible lid 20, and biasing the flexible lid inwardly with the bias member 35. The method further includes depositing one or more food products 11, such as potato crisps or cookie biscuits, inside the tubular body ply 13 such that the food products are stacked upon one another adjacent the flexible lid 20. According to one embodiment, the method also includes applying a vacuum to the open end of the tubular container 10 and closing the open end of the tubular body ply 13 with another end closure, which in one embodiment is a metal end closure. In this regard, a preferred metal end closure is disclosed in U.S. Pat. No. 5,971,259, which is incorporated herein by reference. After the tubular container 10 has been sealed, the applied vacuum is released, which causes the flexible lid 20 to move towards the food products 11 contained therein. More specifically, an inwardly directed force is applied to the flexible lid 20 when the vacuum is released because of the resultant pressure differential created across the flexible lid 20 by the vacuum process. In a preferred embodiment, the bias member 35 maintains the flexible lid 20 in a biased shape until the overcap is removed. As such, the flexible lid 20 undergoes substantially less inward movement against the food products 11 located adjacent to flexible lid when the vacuum is released, which prevents the food products from being damaged or broken during the packaging process.

Figure 9:
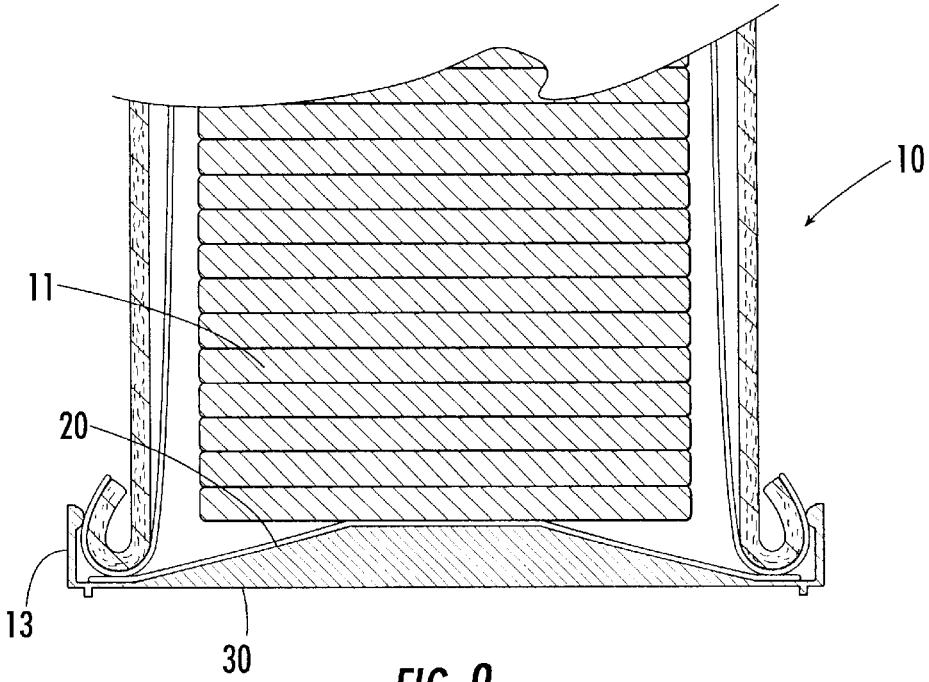
FIG. 9 is a sectional view of the container of the present invention shortly before the vacuum packaging operation.
Figure 10:
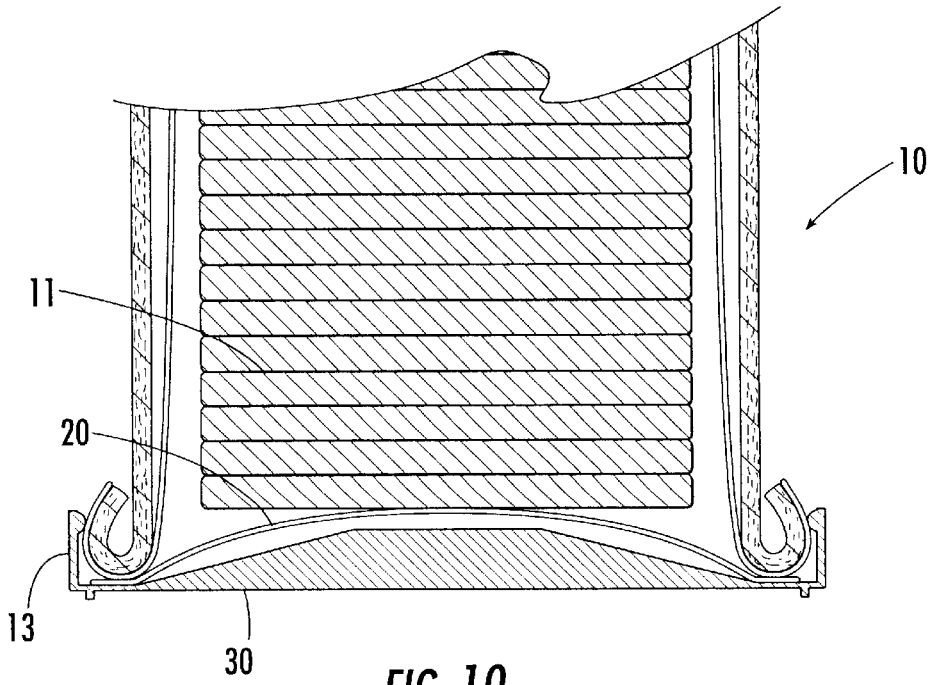
FIG. 10 is a sectional view of the container of the present invention shortly after the vacuum packaging operation.

FIGS. 9 and 10 show sectional views of the container 10 according to the present invention. In particular, FIG. 9 shows the container 10 shortly before the vacuum packaging operation in an inverted position wherein the overcap 30 is secured to the end of the container such that the flexible lid 20 is biased inwardly. According to the present invention, the food products 11 are loaded into the inverted container 10 adjacent the biased lid 20. FIG. 10 shows the container 10 shortly after the vacuum is applied. As shown, the flexible lid 20 is capable of moving slightly inwardly toward the food products 11, but the movement of the lid is greatly restricted due to its pre-vacuum biased shape caused by the bias member 35. Accordingly, the pressing force against the food products 11 created by the movement of the flexible lid 20 is sufficiently limited such that the food products adjacent the lid are not damaged during the vacuum process.

Thus, the present invention provides a tubular composite container 10 and related methods that overcomes the disadvantages of conventional methods and containers. In particular, the container 10 sufficiently restricts the movement of the flexible lid 20 such that the food products located adjacent the flexible lid are not damaged during vacuum packaging. The container 10 can be manufactured using mostly standard techniques and does not require special tools or adhesives, which add additional expense to the standard manufacturing process. Thus, the container 10 of the present invention is particularly advantageous for packaging food products 11 that are delicate or otherwise susceptible to breakage during vacuum packaging. Following the method of the present invention allows the flexible lid 20 to be biased inwardly before the vacuum is applied to the inside of the container 10, such that when the vacuum is applied the pressing force created by the movement of the flexible lid 20 is sufficiently low such that the food products 11 located adjacent the flexible lid are not damaged. In addition, the container 10 is easy to manufacture, yet is capable of withstanding a rigid shape and providing a hermetic seal to prevent air and moisture from contaminating the products contained therein.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, the tubular containers according to the present invention are not necessarily helically wound, but may instead by longintudinarly wrapped to create "convolute" tube having an axially extending seam. In addition, although the tubular containers according to the present invention have been described primarily in connection with food products, it is to be understood that the containers could be used in connection with other products that may be damaged during a vacuum packaging process or that may require the cushioning effect of a vacuum packaging operation. Although specific terms are employed herein, they are used in a generic and descriptive sense only and not for purposes of limitation.

That which is claimed:

1. A tubular composite container for vacuum packaging products, comprising:

a tubular body ply formed of paperboard material having inner and outer surfaces and opposed ends, at least one end of said body ply being rolled outwardly to form a rim;

a flexible membrane-type lid positioned against said rim and sealed thereto; and an overcap attached to said container adjacent said flexible membrane-type lid, said overcap defining a bias member for biasing said membrane-type lid inwardly towards the products before a vacuum is applied.

2. A container according to claim 1, wherein said bias member comprises a rib.

3. A container according to claim 2, wherein said rib has a thickness substantially equal to said base portion.

4. A container according to claim 2, further comprising a plurality of ribs.

5. A container according to claim 1, wherein said bias member has a curved shape.

6. A container according to claim 1, wherein said bias member has a frustoconical shape.

7. A container according to claim 1, further comprising a flexible liner ply adjacent said tubular body ply.

* * * * *